US011352995B2

(12) United States Patent
Wagner et al.

(10) Patent No.: US 11,352,995 B2
(45) Date of Patent: Jun. 7, 2022

(54) PISTON PUMP

(71) Applicant: MAN Energy Solutions SE, Augsburg (DE)

(72) Inventors: Wolfgang Wagner, Dessau-Roßlau (DE); Denis Kovalev, Augsburg (DE); Markus Meixner, Augsburg (DE); Thomas Hamann, Bernburg (DE)

(73) Assignee: MAN ENERGY SOLUTIONS SE, Augsburg (DE)

( * ) Notice: Subject to any disclaimer, the term of this patent is extended or adjusted under 35 U.S.C. 154(b) by 6 days.

(21) Appl. No.: 17/097,411

(22) Filed: Nov. 13, 2020

(65) Prior Publication Data

US 2021/0148319 A1 May 20, 2021

(30) Foreign Application Priority Data

Nov. 14, 2019 (DE) ..... 10 2019 130 6843.1

(51) Int. Cl.

| | |
|---|---|
| ***F02M 59/44*** | (2006.01) |
| ***F04B 1/0421*** | (2020.01) |
| ***F04B 53/04*** | (2006.01) |
| ***F04B 53/16*** | (2006.01) |
| ***F02M 59/10*** | (2006.01) |
| ***F04B 53/00*** | (2006.01) |

(52) U.S. Cl.

CPC ..... *F02M 59/442* (2013.01); *F02M 59/102* (2013.01); *F04B 1/0421* (2013.01); *F04B 53/008* (2013.01); *F04B 53/04* (2013.01); *F04B 53/162* (2013.01)

(58) Field of Classification Search

CPC .. F02M 59/442; F02M 59/102; F04B 1/0421; F04B 53/04; F04B 53/162

USPC ..... 123/456

See application file for complete search history.

(56) References Cited

U.S. PATENT DOCUMENTS

| | | | | |
|---|---|---|---|---|
| 6,439,203 | B1 * | 8/2002 | Cooke | F02M 47/00 123/470 |
| 2004/0052664 | A1 * | 3/2004 | Saito | F02M 59/48 417/490 |
| 2007/0128058 | A1 * | 6/2007 | Kitamura | F04B 1/0404 417/437 |

(Continued)

FOREIGN PATENT DOCUMENTS

| | | |
|---|---|---|
| DE | 10134066 | 2/2003 |
| DE | 102016212339 | 1/2018 |
| JP | 2008-002361 | 1/2008 |

OTHER PUBLICATIONS

Search Report dated Mar. 9, 2021 issued in European Patent Application No. 20205807.9.

(Continued)

*Primary Examiner* — Mahmoud Gimie

(74) *Attorney, Agent, or Firm* — Cozen O'Connor

(57) ABSTRACT

A piston pump as a high-pressure fuel pump of a common rail system includes: a pump cylinder; a pump piston moveably mounted in a recess of the pump cylinder, the pump piston being moveable up and down in the recess; and a leakage groove arranged in the pump cylinder in a region of the recess, the leakage groove being coupled with a leakage line configured to discharge a fuel leakage. Between the pump cylinder and the pump piston a different size pairing clearance is formed in first and second portions of the pump cylinder.

4 Claims, 2 Drawing Sheets

(56) References Cited

U.S. PATENT DOCUMENTS

| | | | | |
|---|---|---|---|---|
| 2013/0104730 | A1* | 5/2013 | Maier | F02M 59/102 92/61 |
| 2014/0102417 | A1* | 4/2014 | Rosu | F02M 59/442 123/507 |
| 2015/0369190 | A1* | 12/2015 | Ropertz | F04B 53/143 417/437 |

OTHER PUBLICATIONS

Office Action dated Sep. 3, 2020 issued in German Patent Application No. 10 2019 130 684.1.

* cited by examiner

PISTON PUMP

BACKGROUND OF THE INVENTION

1. Field of the Invention

The invention relates to a piston pump, in particular to a fuel pump such as a high-pressure fuel pump of a common rail fuel system.

2. Description of the Related Art

Fuel pumps known from practice comprise a pump cylinder, wherein in the pump cylinder a pump piston is moveably mounted. Preferentially, the pump piston is moved up and down in the pump cylinder by way of one or more cams, by way of which fuel is drawn in and from the fuel pump fed to consumers, such as for example injection valves of a fuel system.

FIG. 1 shows a schematized cross section through a fuel pump 10 designed as piston pump known from the prior art, wherein the fuel pump 10 comprises a pump cylinder 11 and a pump piston 12. The pump piston 12 is moveably guided up and down in a recess 13 of the pump cylinder 11, wherein the up-and-down movement of the pump piston 12 in the pump cylinder 11 is preferentially controlled by way of a cam which is not shown.

In particular when in FIG. 1 the pump piston 12 is moved upwards in the recess 13, a compression of the fuel takes place. In the opposite movement direction of the pump piston 12, a suction phase of the fuel pump 10 is present. The fuel can be drawn in by the fuel pump 10 via at least one bore 17*a* in the pump cylinder 11 and, following the compression, fed to consumers such as for example injection valves, via at least one bore 17*b* in the pump cylinder 11.

In the pump cylinder 11, a leakage groove 14 is introduced in order to discharge a fuel leakage which can form during the operation of the fuel pump. To this end, the leakage groove 14 is coupled to a leakage line 15, via which ultimately a fuel leakage is dischargeable into a leakage tank, in which a low pressure, in particular ambient pressure, is present.

The fuel leakage, which forms in the region of the fuel pump 10, depends on the size of a gap 16 between the pump piston 12 and the pump cylinder 11. In order to ensure as low as possible a fuel leakage this gap 16 should be as small as possible which can be provided by a very small pairing clearance between the pump cylinder 11 and the pump piston 12. During the operation of such a fuel pump there is the problem of a so-called piston seizure or plunger seizure, i.e. a seizure of the pump piston 22 in the pump cylinder 21. This results in a fuel pump failure. This is a disadvantage.

There is a need for reducing the risk of such a piston seizure on a piston pump, in particular a fuel pump.

SUMMARY OF THE INVENTION

Starting out from this, it is an object of the invention to create a new type of piston pump.

In accordance with one aspect of the invention, in the piston pump, a different-size pairing clearance is formed between the pump cylinder and the pump piston in different portions. In a portion, in which the pump piston during its up-and-down movement passes over the leakage groove, a larger pairing clearance is formed than in a portion in which the pump piston during its up-and-down movement does not pass over the leakage groove.

With the piston pump according to an aspect of the invention, a different size pairing clearance is formed between the pump cylinder and the pump piston in different portions. In the portion, in which the pump piston during its movement passes over the leakage group in the pump cylinder the pairing clearance is configured larger than in the portion in which the pump piston during its movement does not pass over the leakage groove in the pump cylinder. In this manner a low fuel leakage can be ensured on the one hand through a low pairing clearance, while on the other hand there is no risk of a so-called piston seizure or plunger seizure.

Here, the invention is based on the realization that the risk of a so-called piston seizure or plunger seizure is primarily caused in that the pump cylinder, in the region of the leakage groove, is subject to a lower heat expansion than the pump piston. This can lead to a reduction of the pairing clearance in the region of the leakage groove, as a result of which, in the prior art, a piston seizure or plunger seizure can be caused. Since however according to the invention, in the portion in which the pump piston passes over the leakage groove of the pump cylinder, a larger pairing clearance is adjusted, there is no risk that the pairing clearance as a consequence of a different heat expansion magnitude of pump piston and pump cylinder is lost. In this manner, the risk of a piston seizure or plunger seizure can ultimately be significantly reduced compared with fuel pumps known from the prior art.

Preferentially, the pairing clearance is configured approximately 25% to 125%, particularly preferably 30% to 100%, larger in the portion in which the pump piston during its up-and-down movement passes over the leakage groove than in the portion in which the pump piston during its up-and-down movement does not pass over the leakage groove. This is particularly preferred in order to reduce the risk of a piston seizure or plunger seizure of the fuel pump.

According to an advantageous further development, the pump piston in the portion, with which the pump piston during its up-and-down movement passes over the leakage groove, has a smaller outer diameter than in the portion in which the pump piston, during its up-and-down movement, does not pass over the leakage groove. In this manner, the different pairing clearance between the pump cylinder and the pump piston in the different portions can be easily and reliably adjusted.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Preferred further developments of the invention are obtained from the following description. Exemplary embodiments of the invention are explained in more detail by way of the drawings without being restricted to this. There it shows.

DETAILED DESCRIPTION OF THE PRESENTLY PREFERRED EMBODIMENTS

The invention relates to a piston pump. Preferentially, the invention relates to a fuel pump, in particular a high-pressure fuel pump of a common rail fuel system of an internal combustion engine such as an internal combustion engine of a ship.

Figure 1:
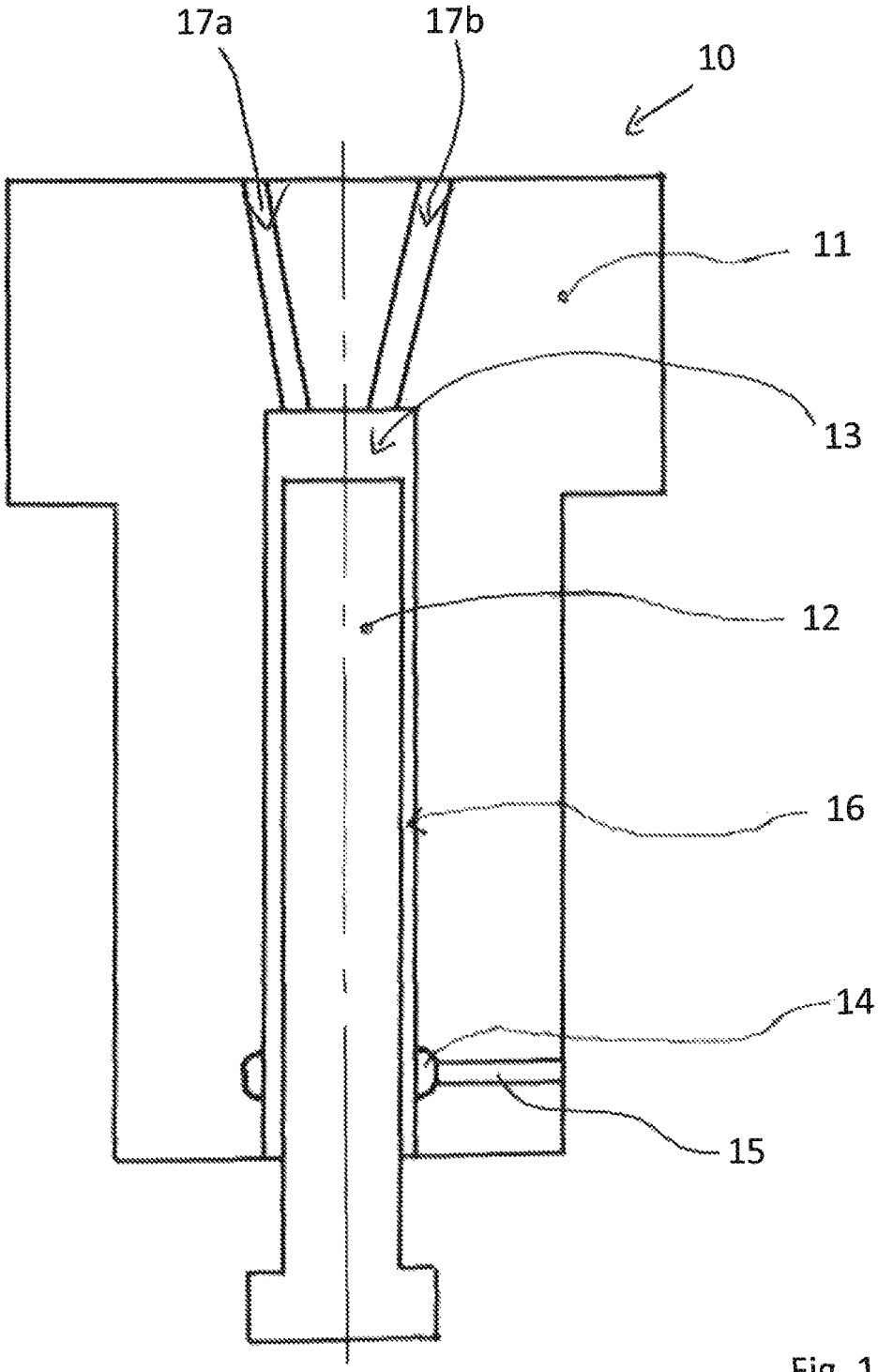
Fig. 1 PRIOR ART
FIG. 1: is a schematic cross section through a fuel pump according to the prior art.
Figure 2:
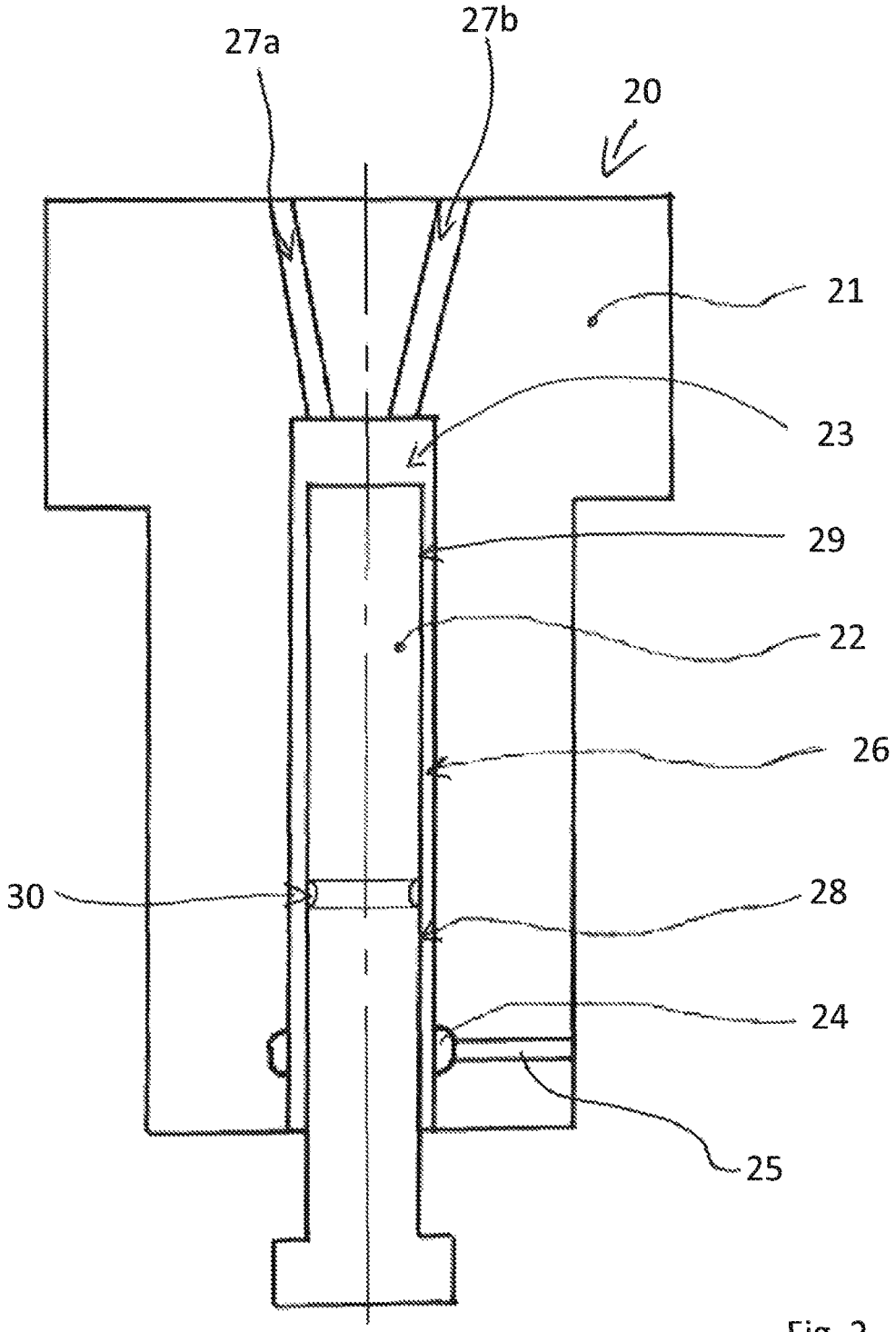
FIG. 2: is a schematic cross section through a fuel pump according to the invention.

FIG. 2 shows a schematic cross section through an exemplary embodiment of a fuel pump 20 according to an aspect of the invention. The fuel pump 20 of FIG. 2 in turn comprises a pump cylinder 21 and a pump piston 22, wherein the pump piston 22 is moveably guided up and down in a recess 23 of the pump cylinder 21, in particular by way of a cam which is not shown.

During the upward movement of the pump piston 22 in the recess 23 towards the top, a compression of the fuel takes place in order to feed the compressed fuel to a consumer via at least one bore 27*b*. In the opposite movement direction downwards, the pump piston 22 draws in fuel via at least one bore 27*a*.

Into the recess 23 of the pump cylinder 21, a leakage groove 24 is introduced, which is coupled with a leakage line 25 for discharging a fuel leakage, which can flow between the pump cylinder 21 and the pump piston 22 via a gap 26 formed between the the pump cylinder 21 and the pump piston 22. By way of the leakage line 25, this fuel leakage is typically discharged into a leakage tank which is not shown, in which low pressure or ambient pressure is present.

According to the invention it is provided that between the pump cylinder 21 and the pump piston 22 a different size pairing clearance is formed in different portions 28 and 29.

In a portion 28, in which the pump piston 22, during its up-and-down movement, passes over the leakage groove 24 of the pump cylinder 21, a larger pairing clearance between pump cylinder 21 and pump piston 22 is formed than in a portion 29, in which the pump piston 22, during its up-and-down movement does not pass over the leakage groove 24. This means that in FIG. 2 in the upper portion 29 a relatively small pairing clearance and in the lower portion 28 a relatively large pairing clearance between the pump piston 22 and the pump cylinder 21 is formed.

Through the relatively small pairing clearance in the upper region 29, the fuel leakage that forms, which flows via the gap 26 between pump cylinder 21 and pump piston 22, can be kept as low as possible.

By way of the larger pairing clearance in the lower portion 28, a different heat expansion of pump piston 20 and pump cylinder 21 in the region of the leakage groove 24, which is caused by the discharge of the fuel leakage, can be taken into account so that in this portion 28 the pairing clearance is not lost and a so-called piston seizure or plunger seizure of the pump piston 22 in the pump cylinder 21 can be prevented.

Preferentially it is provided that in the portion 28, in which the pump piston 22 during its movement in the pump cylinder 21 passes over the leakage groove 24 of the pump cylinder 21, the pairing clearance is formed larger by 25% to 125%, preferentially by 30% to 100% than in the portion 29 in which the pump piston 22, during its movement in the pump cylinder 21, does not pass over the leakage groove 24 of the pump cylinder 21.

The portions 28 and 29 with different pairing clearance between pump piston 22 and pump cylinder 21 are preferentially provided in that in these portions 28 and 29 the pump piston 22 has a different size outer diameter.

In the portion 28, with which the pump piston 22 during its movement passes over the leakage groove 24, a smaller outer diameter on the pump piston 22 is formed than in that portion 29, in which the pump piston 22 during its movement in the pump cylinder 21 does not pass over the leakage groove 24 of the pump cylinder 21.

The recess 23 in the pump cylinder 21 preferentially has a continuously same inner diameter. The smaller the outer diameter of the pump piston 22, the larger is the pairing clearance.

The two portions 28 and 29 of the pump piston 22 with the different size outer diameters are separated from one another in FIG. 2 by a circumferential groove 30 in the pump piston 22. This is preferred in order to avoid a step-like diameter shoulder between the two different portions 28 and 29 of the pump piston 22.

Accordingly it is provided with the invention to embody a different pairing clearance between the pump cylinder 21 and the pump piston 22 in the portions 28 and 29. In the region of the leakage groove 24, a comparatively large pairing clearance is provided for avoiding so-called plunger seizures as a consequence of different heat expansions. Accordingly, the pairing clearance in the lower portion 28, with which the pump piston 22 passes over the leakage groove 24, is larger in the upper portion 29 in which the pump piston 22, during its movement, does not pass over the leakage groove 24. This serves to ensure a low fuel leakage while avoiding the risk of a plunger seizure at the same time. Ultimately, the efficiency of the fuel pump 20 can be increased. The operational safety of the fuel pump 20 can be increased. Should gumming-up form on the pump piston 22, the risk of a plunger seizure can nevertheless be reduced.

The fuel pump 20 is preferentially a high-pressure fuel pump of a common rail fuel system of an internal combustion engine, in particular of a ship diesel internal combustion engine. However, the invention can also be employed with other fuel pumps and piston pumps.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

LIST OF REFERENCE NUMBERS

10 Fuel pump
11 Pump cylinder
12 Pump piston
13 Recess
14 Leakage groove
15 Leakage line
16 Gap

17*a* Bore
17*b* Bore
20 Fuel pump
21 Pump cylinder
22 Pump piston
23 Recess
24 Leakage groove
25 Leakage line
26 Gap
27*a* Bore
27*b* Bore
28 Portion
29 Portion
30 Circumferential groove

What is claimed is:

1. A piston pump (20) as a high-pressure fuel pump of a common rail system, comprising:

a pump cylinder (21);

a pump piston (22) moveably mounted in a recess (23) of the pump cylinder (21), the pump piston (22) being moveable up and down in the recess (23); and a leakage groove (24) arranged in the pump cylinder (21) in a region of the recess (23), the leakage groove (24) being coupled with a leakage line (25) configured to discharge a fuel leakage, wherein between the pump cylinder (21) and the pump piston (22) a different size pairing clearance is formed in first and second portions (28, 29) of the pump piston, wherein in the first portion (28) of the pump piston, in which the pump piston (22) during its up-and-down movement passes over the leakage groove (24), a larger pairing clearance is formed than in the second portion (29) of the pump piston, in which the pump piston (22) during its up-and-down movement does not pass over the leakage groove (24), wherein the pump piston (22), in the first portion (28), has a smaller outer diameter than in the second portion (29), and wherein portions of the pump piston (22) having different size outer diameters are separated from one another by a circumferential groove (30) in the pump piston (22).

2. The pump piston according to claim 1, wherein in the first portion (28), the pairing clearance is formed 25% to 125% larger than in the second portion (29).

3. The pump piston according to claim 1, wherein in the first portion (28), the pairing clearance is formed larger by 30% to 100% than in the second portion (29).

4. The pump piston according to claim 1, wherein the leakage line (25) discharges the fuel leakage in a low-pressure region of the common rail fuel system.

* * * * *